US006038898A

United States Patent [19]

Cliff

[11] Patent Number: 6,038,898

[45] **Date of Patent: *Mar. 21, 2000**

[54] INTERNALLY BITTED KEY CHANGEABLE, AXIAL PIN TUMBLER LOCK AND COMPATIBLE KEY

[75] Inventor: William H. Cliff, Mauldin, S.C.

[73] Assignee: Compx International, Inc., Mauldin, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 09/003,216

[22] Filed: Jan. 6, 1998

[51] Int. Cl.[7] ..... E05B 27/00

[52] U.S. Cl. ..... 70/491; 70/404

[58] Field of Search ..... 70/491, 404, 403, 70/386

[56] References Cited

U.S. PATENT DOCUMENTS

| | | | |
|---|---|---|---|
| 2,982,121 | 5/1961 | George | 70/363 |
| 3,251,205 | 5/1966 | Kerr | 70/404 |
| 3,258,945 | 7/1966 | Kerr | 70/404 |
| 3,509,748 | 5/1970 | Trainor | 70/386 |
| 3,541,819 | 11/1970 | Kerr | 70/386 |
| 3,648,492 | 3/1972 | Walters et al. | 70/383 |
| 3,916,657 | 11/1975 | Steinbach | 70/338 |
| 3,961,507 | 6/1976 | Falk | 70/383 |
| 4,012,931 | 3/1977 | Harunari | 70/386 |
| 4,112,820 | 9/1978 | Conger et al. | 70/421 |
| 4,233,828 | 11/1980 | Dauenbaugh | 70/383 |

*Primary Examiner*—Suzanne Dino Barrett
*Attorney, Agent, or Firm*—Banner & Witcoff, Ltd.

[57] ABSTRACT

An axial pin tumbler lock and key assembly comprise a housing with an axial pin tumbler barrel fixed within the housing and including passages for storage of key change tumblers. A rotatable forward barrel and spindle include axial pin tumblers movable in response to the insertion of an appropriate key of the type having a hollow cylindrical barrel for engagement with the tumblers. The key includes detents on the inside surface of the cylindrical barrel and radial ribs on the outside surface thereof for actuation of the front barrel.

5 Claims, 2 Drawing Sheets

74
40
38
50
48
52
46
28
58
56
64
51
60
42
19
70
21
34
44
64
62
18
32
30
14
62
30
10
12

INTERNALLY BITTED KEY CHANGEABLE, AXIAL PIN TUMBLER LOCK AND COMPATIBLE KEY

BACKGROUND OF THE INVENTION

This invention relates to an improved axial pin tumbler lock and key assembly wherein the key includes detents on the inside of the cylindrical key barrel and projecting ribs on the outside of the barrel. The lock is an axial pin tumbler lock which may have multiple combinations.

Various prior art patents disclose axial pin tumbler locks. Among those is U.S. Pat. No. 4,233,828 which is incorporated herewith by reference. Some axial pin tumbler locks have the capability to change the key combination so that any one of a number of various keys may be utilized with a single lock, and the particular key to be used may be altered or changed by use of a change key. Such locks usually utilize a key which includes a hollow cylinder having detents along the outside edge or surface of the tube. The detents engage cylindrical axial pin tumblers which positioned within a rotating barrel retained within the housing of the lock.

The key change lock referenced in the prior art patent, incorporated herewith by reference, is commercially useful but such a lock has features which require that the lock have an axial length or extent which may, on certain occasions, be undesirable. That is the axial length of such a lock may be too great for certain applications. For that reason, among others, the present lock was developed. The lock construction of the invention maintains the capability to provide multiple key combinations in a single lock and also provides the advantage of having a lesser or dimished axial length relative to prior axial pin tumbler lock constructions. The invention is useful in key change and single key axial pin tumbler locks.

SUMMARY OF THE INVENTION

Briefly, the present invention comprises a pin tumbler lock and key assembly wherein the pin tumbler lock includes an outer housing or cylinder with a rear, tumbler containing barrel retained within the outer housing or cylinder. The rear barrel includes axial pin tumblers which are spring biased and arranged in axial passages arrayed radially spaced about the center line axis of the lock. Multiple axial, pin tumblers may be included within each passage in the rear barrel. A rotatable forward barrel includes axial pin tumblers in passages which may be aligned with those of the rear barrel. The tumblers may then be axially translated to define a line of separation or shear between the forward and rear barrels so that the forward barrel may be rotated relative to the rear barrel and the housing. Rotation is possible and may be effected only upon insertion of the appropriate key with the appropriate bit settings so as to axially move and thereby align the tumblers along the plane of the shear separation between the rear and front barrels.

The key includes a hollow cylindrical tubular member with the axial tumbler bittings defined on the inside surface thereof for engagement with the axial pin tumblers of the lock. The outside surface thereof includes radially projecting ribs which are designed to engage with the front or forward barrel and effect rotation thereof when the appropriate key is appropriately inserted into the lock. The lock further includes a detent ball mechanism which normally locks the front or outer barrel into engagement with the housing, thereby precluding rotation of the front barrel. Upon insertion of a key, a detent ball is received within an opening or passage in the key to permit rotation of the forward barrel within the housing. A center spindle is attached or fixed to the front barrel and rotates therewith in response to insertion of and rotation of the appropriate key in the lock. The spindle includes a driver rod or bar which projects from the rear of the lock and engages a cam or bolt mechanism. The rear barrel may include extra pin storage passages and extra axial pin tumblers to permit the combination of the lock to be altered by movement of tumblers to or from the tumbler storage passages in the fixed rear barrel.

Thus it is an object of the invention to provide an improved axial pin tumbler lock.

It is a further object of the invention to provide an axial pin tumbler lock wherein the lock may be susceptible to change of combinations.

Yet another object of the invention is to provide an improved axial pin tumbler lock which has the capability of a lesser axial dimension relative to prior art axial pin tumbler locks.

Another object of the invention is to provide an axial pin tumbler lock wherein the bitting for the lock is associated with the internal cylindrical surface of a cylindrical barrel of a key.

Yet another object of the invention is to provide an axial pin tumbler lock and the key assembly combination wherein the key is comprised of a cylindrical hollow barrel with radial ribs on the outside and detent cavities or recesses on the inside surface of the barrel.

Yet a further object of the invention is to provide an axial pin tumbler lock wherein the lock includes a rotatable forward barrel and spindle which is actuated when the axial pin tumblers are appropriately aligned with a shear plane separating the forward barrel and a rear barrel attached to the lock housing.

These and other objects, advantages and features of the invention will be set forth in the detailed description which follows.

BRIEF DESCRIPTION OF THE DRAWINGS

In the detailed description which follows, reference will be made to the drawing comprised of the following figures.

DESCRIPTION OF THE PREFERRED EMBODIMENT

Referring to the figures, the axial pin tumbler lock of the invention is depicted and incorporates key change capability similar to that set forth in prior art U.S. Pat. No. 4,233,828 by virtue of the utilization of key change tumblers. Thus the lock constitutes an improvement over prior art locks referenced herein inasmuch as certain parts have been eliminated while the functions associated therewith are retained and further wherein the construction of the key associated with the lock is different from the key used with prior art locks in that the bitting associated with the key is on the inside surface of the cylindrical tube section of the key.

Figure 1:
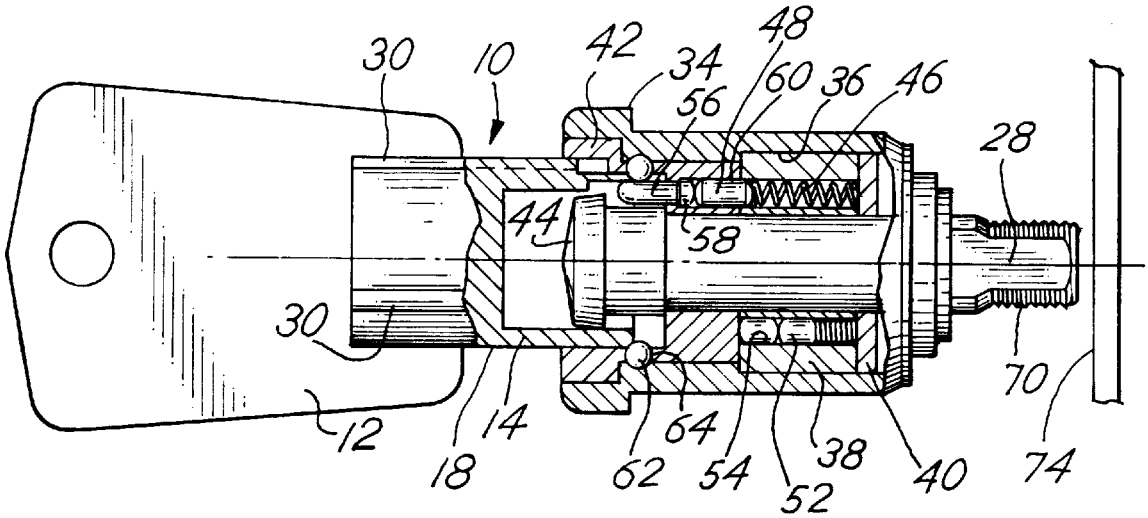
FIG. 1 is a side cross-sectional elevation of the improved lock of the invention.
Figure 3:
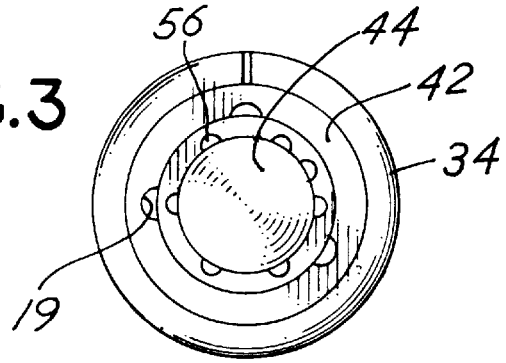
FIG. 3 is a front plan view of the improved lock of the invention.
Figure 4:
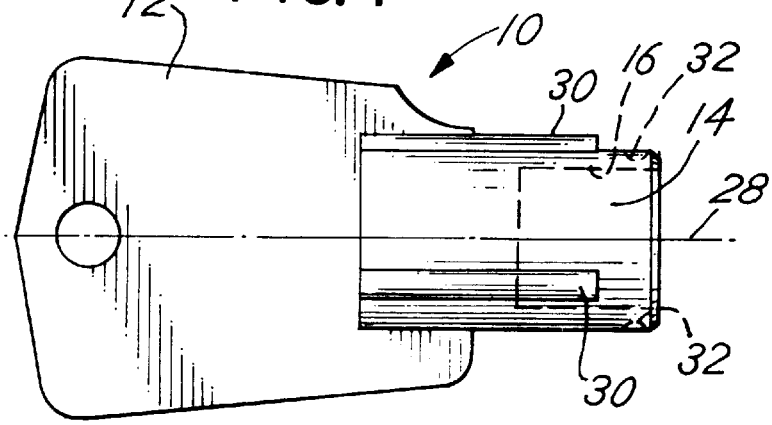
FIG. 4 is a side-elevation of the key utilized in the combination of the invention.
Figure 5:
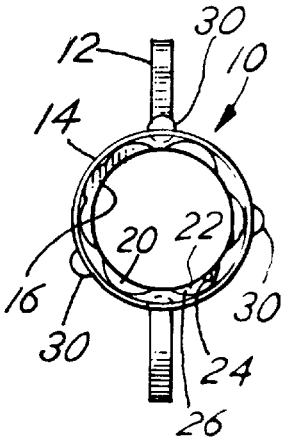
FIG. 5 is a detail of the end view of the key of FIG. 4.
Figure 2:
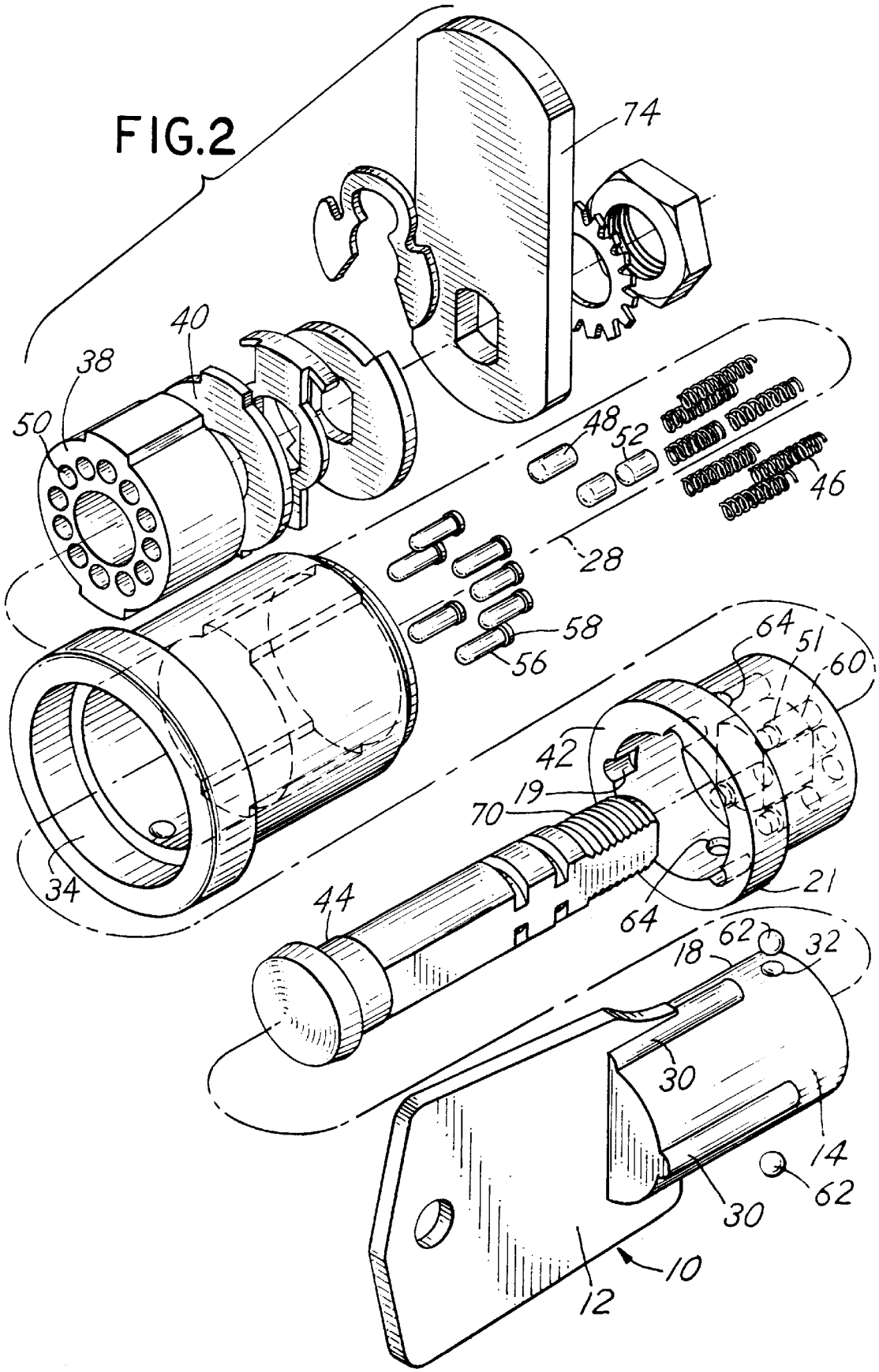
FIG. 2 is an exploded isometric view of the lock of the invention.

Consequently, a key 10 includes a key blade 12 and a cylindrical hollow tube 14. The tube 14 has an inside surface 16 and an outside surface 18. As shown in FIG. 5, for example, the inside surface 16 of the key 10 includes a series of bittings such as bittings 20 and 22 which are defined by scalloped or cylindrical cutouts on the inside surface 16. The scalloped cutouts 20, 22 each include a generally curved or cylindrical surface 24 and a back wall 26. The curved surface has an axis which is generally parallel to a centerline axis 28 of the key 10. The back wall 26 is designed to drive or engage against pin tumblers as described below. The key 10 further includes a plurality of ribs, for example rib 30 attached to the outside surface 18 of tube 14. In the embodiment depicted, the ribs 30 are arranged at a 12:00 position, a 3:00 position and an 8:00 position. As described below, the ribs 30 are arranged at positions which are designed to be congruent with slots defmed in the flange of a rotatable front or outer barrel 42 of the lock.

The key 10 further includes a detent opening 32 which is generally aligned with one or more of the ribs 30. For example, a detent opening 32 is aligned with a rib 30. The detent openings 32 are devised to receive detent balls 62 that normally lock an outer, rotating 42 barrel of a lock to a cylindrical housing. The detent openings 32 thus permit the detent ball 62 described below to be received within the opening 32 so as to permit rotation of a key 10 with an outer barrel on the associated lock spindle.

Thus referring further to the remaining figures, the axial pin tumbler lock includes a housing or cylinder 34 which has a generally cylindrical throughbore or passage 36 and receives a rear barrel 38 which rear barrel 38 is keyed or fixed thereto and held in position by a lock washer or plate 40. The lock further includes a rotatable, forward outer barrel 42 which is keyed to or attached to or integrally formed with a spindle 44. Spindle 44 is aligned axially along rotation axis 28. The outer barrel 42 and spindle 44 are thus rotatable about the axis 28 assuming the tumblers, described below, are arranged appropriately and the key 10 has been engaged appropriately with the outer barrel 42 and the tumblers to permit such a rotation.

Positioned within each axial tumbler passage 50 in the rear barrel 38 is a compression spring 46. Each compression spring 46 engages against rear barrel tumblers 48 in each passage 50. More than one tumbler 48 may be included in the tumbler passage 50 in the rear barrel. Thus a tumbler passage 50 may also include one or more change tumblers 52 which are retrieved from a change tumbler passage 54 per the construction of U.S. Pat. No. 4,233,828. Transfer or movement of change tumblers 52 from a change tumbler storage passage 54 into a lock operations passage 50 may be effected in the manner taught in the prior art patent incorporated herewith.

The tumblers 48 coact with and are cooperative with forward pin tumblers 56 which are retained within passages 60 of the outer barrel 42. Tumblers 56 include an expanded head 58 designed to retain the pin tumblers 56 within the outer barrel 42 by engagement with an appropriate lip or flange 51 associated with each outer barrel passage 60.

Detent balls 62 are retained within passages 64 defined in the outer barrel 42. The detent balls 62 are designed to move into detents 32 in the key 10 as previously described when the proper key 10 is appropriately positioned in the lock, thereby releasing the outer barrel 42 from engagement with the housing 34.

Spindle 44 includes an axial extension 70 which cooperates with a cam or bolt 74. Thus when the outer barrel 42 and spindle 44, which are keyed or fixed to one another or otherwise move uniformly, are rotated about the axis 28, the cam 74 is likewise rotated to effect locking or unlocking operation.

The assembly operates by insertion of the key having the radially outwardly projecting ribs 30 fitted through associated receiving passages 19 in the outer barrel 42 rim 21. As the ribs 30 are fitted through the rim 21 of the outer barrel 42, they engage the sides of the passages 19 and thus upon twisting can effect a rotation of the barrel 42 and spindle 44 upon rotation of the key 10 provided all the tumblers (heretofore described) are properly oriented to define a shear plane between the outer or forward barrel 42 and rear or inner barrel 38 and further provided that the detent balls such as ball 62 appropriately move into and engage in detent openings 32 in the outer surface 18 of the key barrel 14. Thus upon insertion of the key 10 the ribs 30 and associated detents of the key, such as detent 32, effectively release the outer barrel 42 from the housing 34. This also permits effective rotation of the outer housing 42 and spindle 44, provided that the bittings, such as bitting 22, appropriately align all of the tumblers 56 along the shear line between the outer barrel 42 and rear barrel 38. Assuming all of this is effected, then the barrel 42 and spindle 44 may be rotated. Note that the detent balls 62 will retain the key 10 attached to the outer barrel 42 until the key 10 is properly oriented with detent balls 62 associated with detent openings 64 in the inside surface of the housing 34. Thus the detent balls 62 serve the function of holding the key 10 in communication with the lock as the lock and key 10 are turned except when the key 10 reaches the unlocked position or the locked position or the key change position as described in the referenced patents incorporated herewith by reference. That is, a change key can be inserted into the lock and effect rotation of the outer barrel 42 to one of the change key positions. The change key may then be removed and replaced with a new combination key. The new combination key will permit change tumblers 52 to be appropriately transported between the rear barrel 38 and front barrel 42. The change key may then be rotated to the appropriate locking or unlocking position and then removed. Thereafter a new combination is effectively provided for the lock.

Importantly, the bittings 20 are on the inside of the cylindrical barrel 14. The outer side of the barrel 14 coacts with detent balls such as balls 62 and often includes ribs such as ribs 30 which help effect the turning action of the barrel 42 and spindle 44. The key change capability of the lock is thus maintained and security is also enhanced by virtue of the bittings 20 on the inside surface of the cylindrical barrel member 14.

Various changes and alterations may be made to the construction without departing from the spirit and scope of the invention. The invention is therefore to be limited only by the following claims and equivalents thereof.

What is claimed is:

1. A pin tumbler lock and key comprising, in combination:

a lock including:

a cylinder having a throughbore and a centerline axis;

a front barrel with a central throughbore defining an outer cylindrical shell with a key receiving bore on a front side and a centerline axis coaxial with the cylinder centerline axis, said front barrel further including a radially inwardly extending flange at the front side, said front barrel slidably engaged in the cylinder and rotatable about the axis in the cylinder, said front barrel further including at least one slot parallel to the axis, said front barrel slot cut on an inside of said radially depending flange for receipt of a longitudinal, radially projecting rib of said key having a cylindrical tumbler engaging means, said key further including at least one radially projecting rib on the outside of cylindrical tumbler engaging means for engaging said front barrel slot and facilitating rotational movement of the front barrel about the cylinder centerline axis;

said front barrel further including a plurality of coaxial pin tumbler passages spaced from the centerline axis about a circumference of the front barrel and an inwardly depending detent member;

a spindle extending along the centerline axis through the lock to operate a cam by rotation of said cam, said spindle affixed to the front barrel;

a rear barrel fixed to the cylinder and coaxial therewith;

said front and rear barrels including biased axial pin tumblers movable in response to said key to thereby align the tumblers along a line of shear separation of the barrels to thereby permit rotation of the front barrel and spindle relative to the cylinder and rear barrel;

said pin tumblers mounted in the front barrel radially spaced from the axis of rotation of the front barrel;

said cylindrical tumbler engaging means including an inside surface, with an array of tumbler detents on the inside surface for engaging tumblers of said front barrel when the key is fitted into the front barrel; and said key further including a detent opening on the outside surface of the cylindrical tumbler engaging means for receipt of the front barrel detent member and rotation therewith.

2. The pin tumbler lock and key of claim 1 wherein said key includes a plurality of radially projecting ribs on the outside of cylindrical tumbler engaging means for engaging said front barrel slot and facilitating rotational movement of the front barrel about the cylinder centerline axis.

3. The pin tumbler lock and key of claim 1 wherein said front barrel flange has at least two slots parallel to the axis, each of said slots cut on the inside of said radially depending flange for receipt of a longitudinal, radially projecting rib of said key.

4. A pin tumbler lock and key comprising, in combination:

a lock including:

a cylinder having a throughbore and a centerline axis;

a front barrel with a central throughbore defining an outer cylindrical shell with a key receiving bore on a front side and a centerline axis coaxial with the cylinder centerline axis, said front barrel further including a radially inwardly extending flange at the front side, said front barrel slidably engaged in the cylinder and rotatable about the axis in the cylinder, said front barrel flange further including a plurality of slots parallel to the axis, said slots cut on an inside of said radially depending flange for receipt of a plurality of longitudinal, radially projecting ribs of said key, said key including a plurality of radially projecting ribs on the outside of cylindrical tumbler engaging means for engaging said slots and facilitating rotational movement of the front barrel about the cylinder centerline axis;

said front barrel further including a plurality of coaxial pin tumbler passages spaced from the centerline axis about a circumference of the front barrel and an inwardly depending detent member;

a spindle extending along the centerline axis through the lock to operate a cam by rotation of said cam, said spindle affixed to the front barrel;

a rear barrel fixed to the cylinder and coaxial therewith;

said front and rear barrels including biased axial pin tumblers movable in response to said key to thereby align the tumblers along a line of shear separation of the barrels to thereby permit rotation of the front barrel and spindle relative to the cylinder and rear barrel;

said pin tumblers mounted in the front barrel radially spaced from the axis of rotation of the front barrel;

said cylindrical tumbler engaging means having an inside surface with an array of tumbler detents on the inside surface for engaging tumblers of said front barrel when the key is fitted into the front barrel; and said key further including a detent opening on the outside surface of the cylindrical tumbler engaging means for receipt of the front barrel detent member and rotation therewith.

5. A pin tumbler lock and key comprising, in combination:

a lock including:

a cylinder having a throughbore and a centerline axis;

a front barrel with a central throughbore defining an outer cylindrical shell with a key receiving bore on a front side and a centerline axis coaxial with the cylinder centerline axis, said front barrel further including a radially inwardly extending flange at the front side, said front barrel slidably engaged in the cylinder and rotatable about the axis in the cylinder, said front barrel further including a plurality of slots parallel to the axis, said slots cut on an inside of said radially depending flange for receipt of a plurality of longitudinal, radially projecting ribs of said key, said key including a plurality of radially projecting ribs on the outside of cylindrical tumbler engaging member for engaging said slots and facilitating rotational movement of the front barrel about the cylinder centerline axis;

said front barrel further including a plurality of coaxial pin tumbler passages spaced from the centerline axis about a circumference of the front barrel and an inwardly depending detent member;

a spindle extending along the centerline axis through the lock to operate a cam by rotation of said cam, said spindle affixed to the front barrel;

a rear barrel fixed to the cylinder and coaxial therewith;

said front and rear barrels including biased axial pin tumblers movable in response to said key to thereby align the tumblers along a line of shear separation of the barrels to thereby permit rotation of the front barrel and spindle relative to the cylinder and rear barrel;

said pin tumblers mounted in the front barrel radially spaced from the axis of rotation of the front barrel;

said cylindrical tumbler engaging member having an inside surface with an array of tumbler detents on the inside surface for engaging tumblers of said front barrel when the key is fitted into the front barrel; and said key further including a detent opening on the outside surface of the cylindrical tumbler engaging member for receipt of the front barrel detent member and rotation therewith.

* * * * *